United States Patent [19]

Iwamoto et al.

[11] 3,948,510

[45] Apr. 6, 1976

[54] SHEET JAM DETECTOR FOR ELECTROPHOTOGRAPHIC COPYING MACHINE

[75] Inventors: Minoru Iwamoto; Koichi Noguchi, both of Tokyo, Japan

[73] Assignee: Ricoh Co., Ltd., Tokyo, Japan

[22] Filed: Sept. 30, 1974

[21] Appl. No.: 510,675

[30] Foreign Application Priority Data

Nov. 19, 1973 Japan ..... 48-129993

[52] U.S. Cl. ..... 271/258; 271/110; 340/259; 355/14

[51] Int. Cl.[2] ..... B65H 7/06

[58] Field of Search ..... 271/258, 259, 265, 110, 271/111; 340/259; 355/14; 192/127; 198/40

[56] References Cited

UNITED STATES PATENTS

| | | | |
|---|---|---|---|
| 3,355,592 | 11/1967 | Muir | 198/40 X |
| 3,693,969 | 9/1972 | Sakamaki et al. | 271/258 |
| 3,833,896 | 9/1974 | Suzuki | 271/258 |

*Primary Examiner*—Evon C. Blunk
*Assistant Examiner*—Bruce H. Stoner, Jr.
*Attorney, Agent, or Firm*—Frank J. Jordan

[57] ABSTRACT

Timers measure the length of time for the leading edge of the first copy sheet to reach a sensing point at the discharge side of the machine after the copy operation is started and de-energize the machine if the measured time is longer than a predetermined time value, indicating that the first sheet jammed and did not reach the sensing point. If the first sheet reaches the sensing point in less than the predetermined time indicating proper feeding thereof, the length of time between the sensing of the leading edge and the trailing edge of the first sheet at the sensing point is measured, and the machine is deenergized if the measured time is longer than another predetermined value, indicating that the first sheet jammed at the sensing point. If the first sheet passes the sensing point normally (the machine is not de-energized), the length of time between the sensing of the trailing edge of the first sheet and the leading edge of the second sheet at the sensing point is measured, and the machine is de-energized if the measured time is longer than still another predetermined value, indicating that the second sheet jammed and did not reach the sensing point. If the second sheet passes the sensing point normally (the machine is not de-energized), the latter two operations are alternately performed for subsequent sheets until a jam is detected and the machine de-energized or the copying operation is completed without a jam.

11 Claims, 5 Drawing Figures

SHEET JAM DETECTOR FOR ELECTROPHOTOGRAPHIC COPYING MACHINE

The present invention relates to a sheet jam detecting method and system for an electrophotographic copying machine.

In an electrophotographic copying machine or similar apparatus, sheets of uniform size are fed through the machine at regular intervals. Sometimes, due to irregularities or mutilations of the sheets, the sheets will jam in the machine and render the machine inoperative. In extreme cases the machine will be damaged by the jammed sheets. It is therefore desirable to detect sheet jams and de-energize the machine before significant damage can occur. Although methods and systems for detecting sheet jams in copying machines are known in the art, these involve complicated and expensive apparatus.

It is therefore an important object of the present invention to provide a novel and simple method of detecting sheet jams in copying machines and the like which can be embodied by simple and inexpensive apparatus.

It is another important object of the present invention to provide apparatus for detecting sheet jams in copying machines and the like embodying the above method.

The above and other objects, features and advantages of the present invention will become clear from the following detailed description taken with the accompanying drawings, in which.

Throughout the following description, the present invention will be presented as applied to an electrophotographic copying machine, but it will be recognized by one skilled in the art that the present invention may be applied to any type of machine, such as a printing press, in which sheets of uniform size are fed through the machine at regular intervals.

Figure 1:
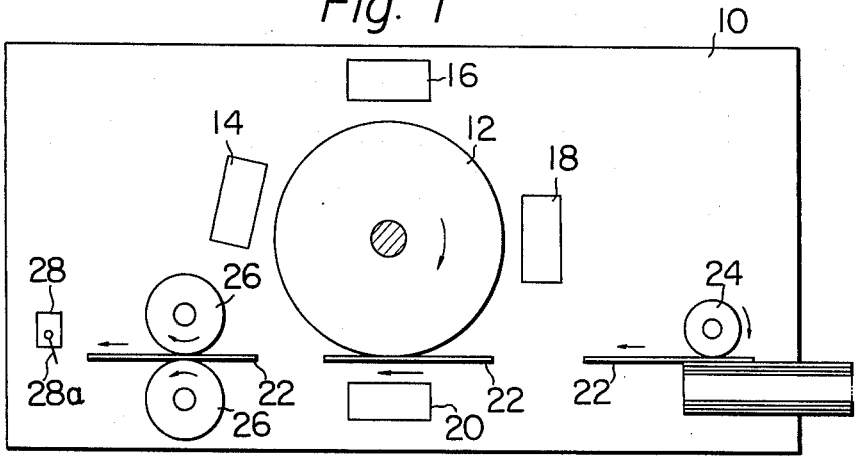
FIG. 1 is a schematic diagram of a copying machine to which the present invention is applicable.

Referring now to FIG. 1, an electrophotographic copying machine 10 comprises a photoconductive drum 12. Operatively arranged adjacent to the drum 12 are a charging station 14, an imaging station 16, a developing station 18 and a transfer station 20. Sheets 22 of copy or transfer paper are fed through the transfer station 20 one by one at regular intervals by a feed roller 24. The sheets 22 are of uniform standard size. In operation, the drum 12 and feed roller 24 rotate as indicated by arrows, and the drum 12 is electrostatically charged at the charging station 14. Subsequently, an image of an original document (not shown) is projected onto the charged surface of the drum 12 at the imaging station 16, and the charge is dissipated in the light areas of the image to create a latent electrostatic image on the drum 12. Next, charged toner particles are deposited on the drum 12 at the developing station 18 to form a toner image on the drum 12. At the transfer station 20, the toner image is transferred onto a sheet 22 fed in contact with the surface of the drum 12 and fixed onto the sheet 22 at a fixing station (not shown). Upper and lower pinch rollers 26 are provided at the discharge end of the machine 10 to feed out the sheets 22. At a predetermined sensing point in the sheet feed path downstream of the pinch rollers 26 is disposed sensing means here shown as being constituted by a switch 28.

The switch 28 is arranged to sense the presence and absence of a sheet 22 at the predetermined point, and may be replaced by a photoelectric sensor or the like which provides the same function.

Figure 2:
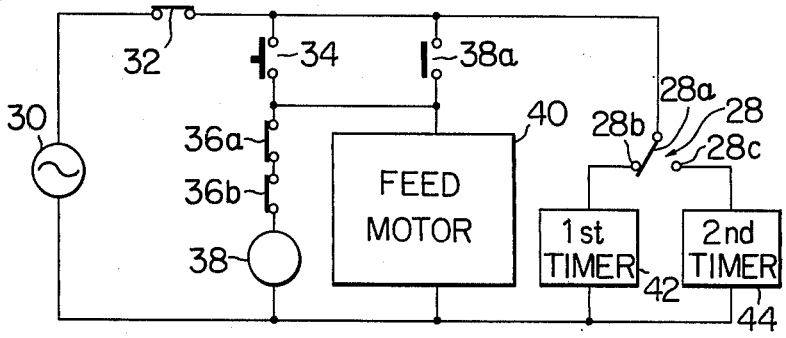
FIG. 2 is an electrical schematic diagram, partly in block form, of the copying machine shown in FIG. 1 incorporating a sheet jam detection system embodying the present invention.

Referring now to FIG. 2, a 24 volt alternating current power source 30 is provided, and a main power switch 32 is connected to one terminal of the source 30. Connected in series between the switch 32 and the other terminal of the source 30 are a print switch 34, normally closed relay contacts 36*a* and 36*b* and a relay coil 38. Normally open contacts 38*a* controlled by the relay coil 38 are connected in parallel with the print switch 34. A feed motor 40 arranged to drive the drum 12, feed roller 24 and pinch rollers 26 is connected in series with the relay contacts 38a across the power source 30.

The switch 28 is shown to comprise a movable contact 28*a* arranged to be moved by the sheets 22 and contact one of fixed contacts 28*b* and 28*c*. The movable contact 28*a* is arranged to normally contact the fixed contact 28*b* when a sheet 22 is absent and be moved by a sheet 22 to contact the fixed contact 28*c* when a sheet 22 is present at the predetermined point at which the switch 28 is disposed. In the condition shown, a first timer 42 is connected across the power source 30 through the contacts 28*a* and 28*b* and switch 32, and when the switch 28 is shifted so that the contact 28*a* contacts the contact 28*c*, a second timer 44 is connected across the power source 30 through the contacts 28*a* and 28*c* and switch 32.

The print switch 34 is a momentary contact switch, and in combination with the relay coil 38 and associated contacts 38*a* constitutes initiator means to energize the feed motor 40 and begin the copying operation. The coil 38 and contacts 38*a* constitute a holding relay. In operation, with the power switch 32 closed, the print switch 34 is momentarily closed by the machine operator to begin the copying operation. The relay coil 38 is thereby connected across the power source 30 through the main power switch 32, print switch 34 and relay contacts 36*a* and 36*b*. The relay coil 38 is energized and closes the normally open contacts 38*a*. The relay coil 38 will be thereby connected across the power source 30 through the power switch 32 and relay contacts 38*a*, 36*a* and 36*b*. Thus, even when the print switch 34 is opened, the relay coil 38 will remain energized and the contacts 38*a* closed. Also, the feed motor 40 will be energized since it is connected across the power source 30 through the main switch 32 and the relay contacts 38*a*.

Figure 3:
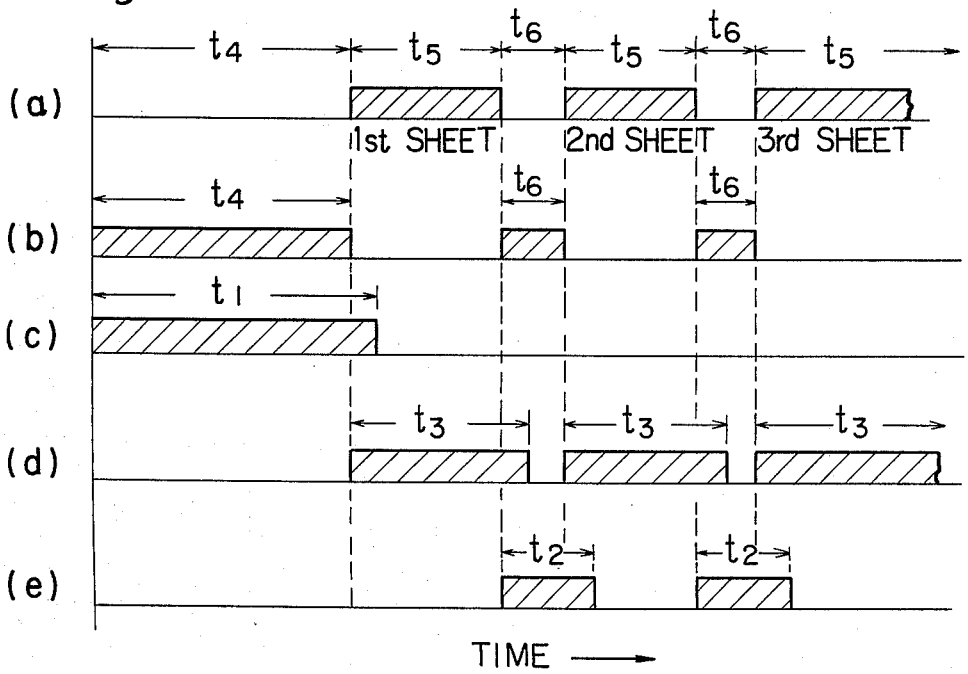
FIG. 3 is a timing diagram of the system shown in FIG. 2.

The main principles of the present invention will now be described with reference to FIG. 3. The horizontal axes in all of FIGS. 3*a* to 3*e* represent time, with the leftmost vertical axis representing the time at which the print switch 34 is closed to start the copying operation. FIGS. 3*a* and 3*b* illustrate the states of the switch 28. The hatched areas in FIGS. 3*a* and 3*b* indicate the times when the movable contact 28*a* contacts the fixed contacts 28*c* and 28*b* to select the second and first timer 44 and 42 respectively. The switch 28 is arranged to act as a sensor to detect the presence and absence of a sheet 22 at the sensing point at which the switch 28 is disposed, and the hatched areas in FIGS. 3*a* and 3*b* indicate the times a sheet is present and absent respectively at the sensing point.

After a time interval or duration $t_4$ has elapsed from the time the print switch 34 is closed, the first sheet 22 will be fed through the transfer station 20 and pinch rollers 26 and the leading edge of the first sheet 22 will engage with the movable contact 28*a* of the switch 28 so that the movable contact 28*a*, which was engaged with the fixed contact 28*b* to select the first timer 42, will be shifted to engage with the fixed contact 28*c* and the second timer 44 will be selected. It is assumed that the sheets 22 are being fed normally through the copying machine 10. If the dimension of the sheets 22 in the direction of feeding is taken as $s_1$ and the feed rate is $v$, a time interval $t_5$ required for the trailing edge of the first sheet 22 to reach the movable contact 28*a* after the leading edge of the sheet 22 has reached the contact is 28*a* is $$t_5 = s_1/v \quad (1)$$

Next, assuming that the distance between the trailing edge of the first sheet 22 and the leading edge of the second sheet 22 is $s_2$, a time interval $t_6$ required for the leading edge of the second sheet 22 to reach the contact 28*a* after the trailing edge of the first sheet 22 has reached the contact 28*a* is $$t_6 = s_2/v \quad (2)$$

In other words, since the switch 28 is arranged to sense the presence and absence of the sheets 22 at the sensing point, the time interval $t_4$ is that between the energization of the feed motor 40 by the print switch 34 and the detection of the presence of the first sheet 22 by the switch 28. The time interval $t_5$ is the interval between the detection of the presence of the first sheet 22 (the leading edge thereof) and the subsequent absence of the first sheet 22 (the trailing edge of the first sheet 22 clearing the movable contact 28*a*). The time interval $t_6$ is the interval between the detection of the subsequent absence of the first sheet 22 and the detection of the presence of the second sheet 22 (the leading edge thereof). Since the dimensions $s_1$ and $s_2$ and the feed rate $v$ are uniform or constant, the intervals $t_5$ and $t_6$ will be the same for all of the respective sheets 22 and the interval $t_4$ is associated with the first sheet 22 only.

The first timer 42 is arranged to have two timing durations $t_1$ and $t_2$, and the second timer 44 is arranged to have one timing duration $t_3$. The durations $t_1$, $t_2$ and $t_3$ are shown in FIGS. 3*c*, 3*e* and 3*d* respectively, and are related to the intervals $t_4$, $t_5$ and $t_6$ as follows:

$$t_4 + t_5 > t_1 > t_4 \quad (3)$$

$$t_5 + t_6 > t_2 > t_6 \quad (4)$$

$$t_5 + t_6 > t_3 > t_5 \quad (5)$$

Preferably, $t_1$, $t_2$ and $t_3$ are slightly greater than $t_4$, $t_6$ and $t_5$ respectively as shown.

In operation, the first timer 42 is initially set to the timing duration or interval $t_1$, which is slightly greater than the interval $t_4$ required for the leading edge of the first sheet 22 to reach the contact 28*a*. The first timer 42 contains a relay coil, which will be described in detail below, operative to open the contacts 36*a* and 36*b* and thereby de-energize the feed motor 40 if the interval $t_1$ elapses before the leading edge of the first sheet 22 reaches the movable contact 28*a*. If the feed operation is normal, the feed motor 40 will not be deenergized, but if the first sheet 22 is jammed in the feed roller 24, transfer station 20, fixing station (not shown) or pinch rollers 26, the first sheet 22 will not reach the movable contact 28a in the normal interval $t_4$, and the first timer 42 will de-energize the feed motor 40 to prevent further jamming of the machine 10 by subsequent sheets 22 and damage to the machine 10.

Assuming that the leading edge of the first sheet 22 has reached the movable contact 28a in the normal time interval $t_4$, the switch 28 will be shifted by the leading edge of the first sheet 22 to set the second timer 44 and reset the first timer 42. The second timer 44 is set for the duration $t_3$, which is slightly greater than the duration $t_5$ required for the first sheet 22 to pass by the switch 28. The second timer 44 controls the relay coil operative to open the contacts 36*a* and 36*b* and de-energize the feed motor 40 if the interval $t_3$ elapses before the timer 44 is reset by the trailing edge of the first sheet 22 clearing the movable contact 28*a*. If the feed operation is normal, the feed motor 40 will not be de-energized, but if the first sheet 22 jams while passing by the switch 28, the trailing edge of the first sheet 22 will not clear the movable contact 28*a* in the time interval $t_3$ and the feed motor 40 will be de-energized.

Assuming that the trailing edge of the first sheet 22 clears the movable contact 28*a* in the normal time interval $t_5$, the second timer 44 will be reset and the first timer 42 will be set to the timing interval $t_2$ by the shifting of the switch 28. The timing interval $t_2$ is slightly greater than the interval $t_6$ required for the leading edge of the second sheet 22 to reach the contact 28*a* after the trailing edge of the first sheet 22 clears the contact 28*a*. If the feed operation is normal, the motor 40 will not be de-energized, but if the interval $t_2$ elapses before the leading edge of the second sheet 22 reaches the movable contact 28*a* after the trailing edge of the first sheet 22 has cleared the movable contact 28*a*, the feed motor 40 will be de-energized indicating that the second sheet 22 has jammed in the feed roller 24, transfer station 20, fixing station (not shown) or pinch rollers 26.

Subsequently, the operations of comparing the intervals $t_3$ and $t_5$, and $t_2$ and $t_6$ are repeated for the subsequent sheets 22 until the copying operation is terminated by opening the main switch 32 or other means (not shown), a jam is detected and the feed motor 40 de-energized or the last sheet 22 passes the switch 28. It will be noticed that the present invention further provides an automatic shut-off function if the copy machine 10 runs out of sheets 22, since after the trailing edge of the last sheet 22 clears the switch 28*a*, the interval $t_2$ will be exceeded since there is not another sheet 22 to reset the first timer 42.

Figure 4:
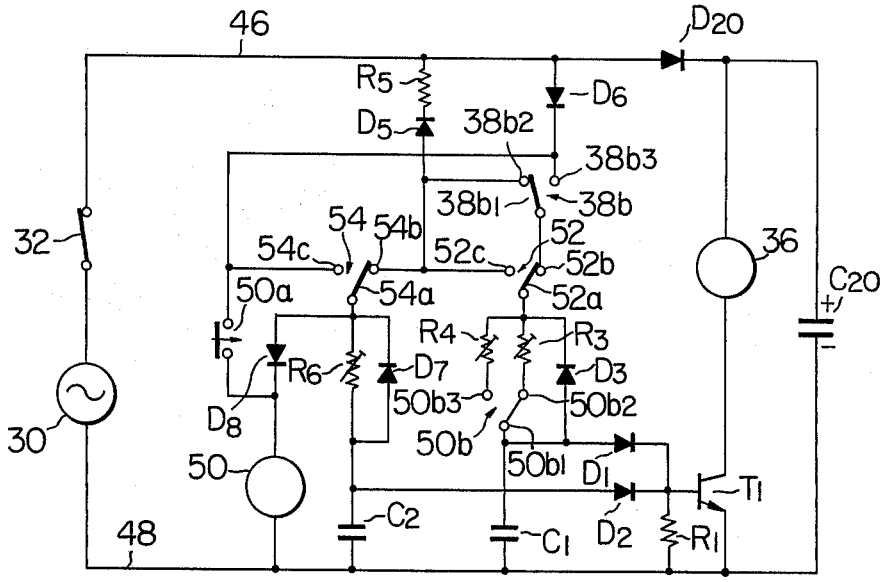
FIG. 4 is an electrical schematic diagram of part of the system shown in FIG. 2.

The configuration of the timers 42 and 44 is shown in FIG. 4. Terminator means to de-energize the feed motor 40 when a sheet jam is detected include the previously mentioned relay coil, designated as 36, operative to open the contacts 36*a* and 36*b* when energized. An NPN driver transistor $T_1$ has its emitter and collector connected in series with the relay coil 36 and a diode $D_{20}$ across bus lines 46 and 48 connected to the terminals of the power source 30 through the switch 32 (see FIG. 2). The anode of the diode $D_{20}$ is connected to the bus line 46, and a capacitor $C_{20}$ is connected between the cathode of the diode $D_{20}$ and the bus line 48. The transistor $T_1$ acts as a voltage level detector to energize the relay coil 36 when the input voltage (to the base) thereof is above a predetermined switching value. An OR gate constituted by diodes $D_1$ and $D_2$ having their cathodes connected to the base of the transistor $T_1$ and a resistor $R_1$ connected between the base and emitter of the transistor $T_1$ will be operatively described below.

The first timer 42 includes a capacitor $C_1$ having one end connected to the bus line 48 and the other end connected to the anode of the diode $D_1$. A movable contact 50$b_1$ of a set of relay contacts 50*b* is also connected to the anode of the diode $D_1$, as is the anode of a diode $D_3$. The cathode of the diode $D_3$ is connected to a movable contact 52*a* of a switch 52. A variable resistor $R_3$ is connected between a fixed contact 50$b_2$ of the contacts 50*b* and the movable contact 52*a*. A variable resistor $R_4$ is connected between a fixed contact 50$b_3$ of the contacts 50*b* and the movable contact 52*a*. A fixed contact 52c of the switch 52 is connected to the anode of a diode $D_5$, the cathode of which is connected through a resistor $R_5$ to the bus line 46. A fixed contact 52*b* of the switch 52 is connected to a movable contact 38*b*, of a set of contacts 38*b*. A fixed contact 38$b_2$ of the contacts 38*b* is connected to the anode of the diode $D_5$, and a fixed contact 38$b_3$ of the contacts 38*b* is connected to the cathode of a diode $D_6$, the anode of which is connected to the bus line 46.

The second timer 44 includes a capacitor $C_2$ having one end connected to the bus line 48 and the other end connected to the anode of the diode $D_2$. The anode of a diode $D_7$ is also connected to the anode of the diode $D_2$, and the cathode thereof is connected to a movable contact 54*a* of a switch 54. A variable resistor $R_6$ is connected in parallel with the diode $D_7$. A fixed contact 54*b* of the switch 54 is connected to the anode of the diode $D_5$, and another fixed contact 54*c* of the switch 54 is connected to the cathode of the diode $D_6$. The anode of a diode $D_8$ is connected to the movable contact 54*a*, and a relay coil 50 is connected between the cathode of the diode $D_8$ and the bus line 48. A set of normally open relay contacts 50*a* is connected between the fixed contact 54*c* and the cathode of the diode $D_8$.

The system is shown in simplified form in FIG. 2, and in FIG. 4, the switch 28 is replaced by the switches 52 and 54. The movable contact 28*a* which senses the presence and absence of the sheets 22 is replaced by the movable contacts 52*a* and 54*a*, which are ganged together, in FIG. 4. When a sheet 22 is absent at the sensing point, the contacts 52*a* and 52*b* and the contacts 54*a* and 54*b* engage. When a sheet 22 is present, the contacts 52*a* and 52*c* and the contacts 54*a* and 54*c* engage. The normally open contacts 50*a* are actuated by the relay coil 50, as are the contacts 50*b*. The relay coil 50 and contacts 50*a* and 50*b* constitute a holding relay which functions as a changeover means to select the duration $t_1$ or $t_2$ of the first timer 42 as will be operatively described below. When the relay coil 50 is de-energized, the changeover means is in a first state in which the contacts 50*a* are open and the movable contact 50$b_1$ contacts the fixed contact 50$b_2$. When the relay coil 50 is energized, the changeover means is in a second state in which the holding contacts 50*a* are closed and the movable contact 50$b_1$ contacts the fixed contact 50$b_3$. The contacts 38b are actuated by the relay coil 38, and the movable contact 38$b_1$ contacts the fixed contacts 38$b_2$ and 38$b_3$ when the relay coil 38 is de-energized and energized respectively.

In operation, the main power switch 32 is first closed, and all switches and relay contacts are in the states shown in FIG. 4. The capacitor $C_1$ is negatively charged through the resistor $R_5$, diode $D_5$, contacts 38$b_2$ and 38$b_1$, contacts 52*b* and 52*a* and the diode $D_3$ so that the anode of the diode $D_1$ is negative relative to the emitter of the transistor $T_1$. The diode $D_1$ is reverse biased and the transistor $T_1$ is non-conductive, so that the relay coil 36 is de-energized. Similarly, the capacitor $C_2$ is negatively charged through the resistor $R_5$, diode $D_5$, contacts 54*b* and 54*a* and the diode $D_7$. It will be appreciated that the negative charging rates of the capacitors $C_1$ and $C_2$ are determined by the value of the resistor $R_5$, since the diodes $D_3$ and $D_7$ are forward biased and effectively shunt the resistors $R_3$ and $R_6$ respectively. Preferably, the value of the resistor $R_5$ is low to permit rapid negative charging.

Next, the print switch 34 is momentarily closed to begin the copying operation, energizing the feed motor 40 as described with reference to FIG. 2. Energization of the relay coil 38 causes the movable contact 38$b_1$ to shift from the fixed contact 38$b_2$ into engagement with the fixed contact 38$b_3$. Since the diode $D_3$ is now reverse biased, the capacitor $C_1$ will begin to charge positively through the diode $D_6$, contacts 38$b_3$ and 38$b_1$, contacts 52*b* and 52*a*, the resistor $R_3$ and the contacts 50$b_2$ and 50$b_1$. The diode $D_1$ becomes forward biased when the voltage across the capacitor $C_1$ exceeds zero, and the voltage across the capacitor $C_1$ is applied to the base of the transistor $T_1$ through the diode $D_1$. If the base voltage of the transistor $T_1$ exceeds the predetermined value before the switch 52 is shifted, the transistor $T_1$ will conduct and the relay coil 36 will be energized to de-energize the feed motor 40 as described above. The time constant of the combination of the resistor $R_3$ and capacitor $C_1$ is selected so that the voltage across the capacitor $C_1$ will reach the predetermined switching value of the transistor $T_1$ in the time interval $t_1$.

Assuming that the leading edge of the first sheet 22 reaches the movable contacts 52*a* and 54*a* in the normal time $t_4$, the contacts 52*a* and 54*a* will be moved thereby to engage with the contacts 52*c* and 54*c* respectively. The capacitor $C_1$ is then reset or negatively charged through the resistor $R_5$, diode $D_5$, contacts 52*c* and 52*a* and the diode $D_3$. On the other hand, the capacitor $C_2$ of the second timer 44 starts to positively charge (is set) through the diode $D_6$, contacts 54*c* and 54*a* and the resistor $R_6$. The transistor $T_1$ will conduct to de-energize the feed motor 40 in a manner similar to that described above if the voltage across the capacitor $C_2$ reaches the predetermined switching value of the transistor $T_1$ before the trailing edge of the first sheet clears the contacts 52*a* and 54*a*. The time constant of the resistor $R_6$ and capacitor $C_2$ are selected so that the voltage across the capacitor $C_2$, which is applied to the base of the transistor $T_1$ through the diode $D_2$, will reach the predetermined switching level of the transistor $T_1$ in the time interval $T_3$.

In addition, as the contacts 54*a* and 54*c* engage, the relay coil 50 is energized through the diode $D_8$. The holding relay contacts 50*a* are thereby closed to maintain the relay coil 50 energized therethrough until the main switch 32 is opened, even when the contacts 54*a* and 54*c* disengage. Energization of the coil 50 causes the movable relay contact $50b_1$ to move into engagement with the fixed contact $50b_3$ to switch the timing duration of the first timer 42 from $t_1$ to $t_2$.

Assuming that the trailing edge of the first sheet 22 clears the switch contacts 52*a* and 54*a* in the normal time $t_5$, the movable contacts 52*a* and 54*a* will move into engagement with the fixed contacts 52*b* and 54*b* respectively. The capacitor $C_2$ will then be negatively charged or reset through the resistor $R_5$, diode $D_5$, contacts 54*b* and 54*a* and the diode $D_7$ as described above. On the other hand, the capacitor $C_1$ will begin to positively charge through the diode $D_6$, contacts $38b_3$ and $38b_1$, contacts 52*b* and 52*a*, the resistor $R_4$ and the contacts $50b_3$ and $50b_1$. If the leading edge of the second sheet 22 reaches the switches 52 and 54 in the normal time $t_6$, the feed motor 40 will not be de-energized. However, if the interval $t_2$ elapses before the leading edge of the second sheet 22 reaches the switches 52 and 54, the voltage across the capacitor $C_1$ will reach the predetermined switching value of the transistor $T_1$ to cause the transistor $T_1$ to conduct and de-energize the feed motor 40. The time constant of the resistor $R_4$ and the capacitor $C_1$ is selected so that the voltage across the capacitor $C_1$ reaches the predetermined switching value for the transistor $T_1$ in the time interval $t_2$.

The above operations are repeated for subsequent sheets 22 until a jam is detected or the copying operation is completed. The relay coil 50, however, remains energized so that the contacts $50b_1$ and $50b_3$ remain engaged since the interval $t_1$ associated with the resistor $R_3$ is only timed once for the first sheet 22.

Figure 5:
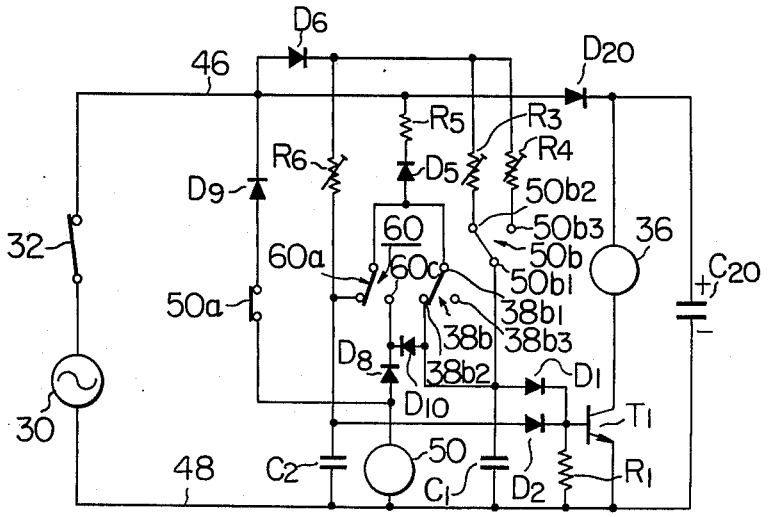
FIG. 5 is an electrical schematic diagram illustrating a modified form of the part of the system shown in FIG. 4.

FIG. 5 shows a simplified arrangement of the timers 42 and 44 and associated components shown in FIG. 4. Like parts are identified with the same reference numerals. The terminator means including the relay coil 36, transistor $T_1$, diode $D_1$ and $D_2$ and resistor $R_1$ is connected to the capacitors $C_1$ and $C_2$ as in FIG. 4.

Differing from the embodiment of FIG. 4, the resistors $R_3$, $R_4$ and $R_6$ are each connected at one end to the cathode of the diode $D_6$. The diodes $D_3$ and $D_7$ are omitted. The movable contact $38b_1$ is here connected to the anode of the diode $D_5$, the contact $38b_2$ is connected to the anode of the diode $D_1$ and the contact $38b_3$ is not connected to anything. The switches 52 and 54 are replaced with a single switch 60 having a movable contact 60*a* which performs the same function as the movable contact 28*a* shown in FIG. 2, and is connected to the anode of the diode $D_5$. A fixed contact 60*b* is connected to the junction between the capacitor $C_2$ and the resistor $R_6$. Another fixed contact 60*c* of the switch 60 is connected to the cathode of the diode $D_8$ and also to the cathode of a diode $D_{10}$, the anode of the diode $D_{10}$ being connected to the anode of the diode $D_1$. The relay coil 50 is connected between the anode of the diode $D_8$ and the bus line 48. It will be noticed that the polarity of the diode $D_8$ is reversed in this embodiment. The cathode of a diode $D_9$ is connected to the bus line 46, and the contacts 50*a* are connected between the anodes of the diodes $D_8$ and $D_9$.

The operation of the embodiments of FIGS. 4 and 5 are similar, so only the differences will be described. In FIG. 5, when the main switch 32 is closed, the capacitor $C_1$ is negatively charged through the resistor $R_5$, diode $D_5$ and contacts $38b_1$ and $38b_2$. The capacitor $C_2$ is also negatively charged through the resistor $R_5$, diode $D_5$ and contacts 60*a* and 60*b*. When the print switch 34 is closed, the contact $38b_1$ is moved by the coil 38 to contact the contact $38b_3$, and the capacitor $C_1$ begins to positively charge through the diode $D_6$, resistor $R_3$ and contacts $50b_1$ and $50b_2$. When the leading edge of the first sheet 22 reaches the movable contact 60*a*, the same will be moved into engagement with the fixed contact 60*c*. The capacitor $C_1$ will then be negatively charged or reset through the resistor $R_5$, diode $D_5$, contacts 60*a* and 60*c* and the diode $D_{10}$. Also, the capacitor $C_2$ will begin to positively charge through the diode $D_6$ and the resistor $R_6$. The relay coil 50 will be energized through the diode $D_8$ to close the holding contacts 50*a* and move the contact $50b_1$ to engage with the contact $50b_3$. When the trailing edge of the first sheet 22 clears the movable contact 60*a*, the contact 60*a* will again engage with the fixed contact 60*b*. The capacitor $C_2$ will negatively charge as before and the capacitor $C_1$ will begin to positively charge through the resistor $R_4$ and contacts $50b_3$ and $50b_1$.

It will be appreciated that the time intervals $t_1$, $t_2$ and $t_3$ can be easily adjusted to specification by varying the values of the variable resistors $R_3$, $R_4$ and $R_6$ respectively in both embodiments shown.

The present invention is based on the method of comparing the time intervals $t_4$, $t_5$ and $t_6$ with the time intervals $t_1$, $t_3$ and $t_2$ respectively. The electrical circuits shown in the figures are exemplary only and can be replaced by any other means operative to perform the same function, as is well known to one skilled in the art.

What is claimed is:

1. In an apparatus having feed means to feed sheets of uniform size through the apparatus one by one at regular intervals, a system for detecting a failure in the feeding of the sheets, said system comprising:

initiator means operative to energize the feed means;

terminator means operative to de-energize the feed means;

sensing means operative to sense the presence and absence of a sheet at a predetermined location in the sheet feed path of the apparatus;

first and second timing means responsive to the sensing means and connected to control the terminator means, the first timing means having two predetermined timing durations $t_1$ and $t_2$ and the second timing means having one predetermined timing duration $t_3$;

the first timing means being connected to the initiator means and set thereby to the first timing duration $t_1$ to begin timing when the initiator means energizes the feed means, the first timing means being shifted by the sensing means to the second timing duration $t_2$ when the presence of the first sheet is detected by the sensing means;

the first timing means being set to the second timing duration $t_2$ to begin timing when the subsequent absence of any sheet is detected by the sensing means and reset when the presence of the next sheet is detected by the sensing means, the second timing means being set to the third timing duration $t_3$ to begin timing when the presence of any sheet is detected by the sensing means and reset when the subsequent absence of the same sheet is detected by the sensing means;

the first and second timing means being arranged to control the terminator means to de-energize the feed means when any of the respective timing durations $t_1$, $t_2$ and $t_3$ elapses before the respective timing means is reset by the sensing means, the timing durations $t_1$, $t_2$ and $t_3$ being predetermined as follows:

$$t_4 + t_5 > t_1 > t_4$$

$$t_5 + t_6 > t_2 > t_6$$

$$t_5 + t_6 > t_3 > t_5$$

where $t_4$ is the time duration between the energization of the feed means by the initiator means and the detection of the presence of the first sheet by the sensing means;

$t_5$ is the duration between the detection of the presence of any sheet and the detection of the absence of the same sheet by the sensing means; and $t_6$ is the duration between the detection of the subsequent absence of any sheet and the detection of the presence of the next sheet by the sensing means when the feed of sheets through the apparatus is normal.

2. A system according to claim 1, in which the apparatus is an electrophotographic copying machine having stations to consecutively perform the respective steps of charging, imaging, developing and transferring of an image to the sheets when the sheets are fed through the transfer station, and in which the sensing means is arranged at the predetermined point which is downstream of the transfer station in the sheet feed path.

3. A system according to claim 1, in which the first timing means comprises changeover means responsive to the sensing means and arranged to control the selection of the timing durations $t_1$ and $t_2$ of the first timing means;

the changeover means being arranged to assume a first state when the initiator means energizes the feed means in which the first timing means is set to the first timing duration $t_1$; and the changeover means is arranged to be shifted to a second state by the sensing means when the first sheet is detected by the sensing means in which the first timing means is set to the second timing duration $t_2$.

4. A system according to claim 3, in which the changeover means comprises a holding relay having contacts arranged to constitute the first state of the changeover means when the relay coil of the holding relay is de-energized and to constitute the second state when the relay coil is energized, the relay coil being de-energized when the initiator means energizes the feed means and energized by the sensing means when the presence of the first sheet is detected by the sensing means.

5. A system according to claim 1, in which the initiator means comprises a holding relay and a momentary switch arranged to energize the holding relay coil when closed, the holding relay having normally open contacts connected to an electrical power source in series with the feed means which close when the holding relay coil is energized by closing the momentary switch.

6. A system according to claim 1, in which the terminator means comprises normally closed switch means connected to an electrical power source in series with the feed means, the first and second timing means being arranged to open the switch means of the terminator means to de-energize the feed means when any of the respective timing durations $t_1$ , $t_2$ and $t_3$ elapses before the respective timing means is reset by the sensing means.

7. A system according to claim 6, in which the terminator means further comprises a voltage level detector operative to open the switch means of the terminator means when an input voltage thereto is above a predetermined level; and the second timing means comprises a resistor and capacitor which are connected in series across the power source, the source being adapted to supply direct current, when the second timing means is in its timing condition, the input voltage to the level detector being the voltage across the capacitor which is set to a level lower than the predetermined level when the second timing means is set and rises to the predetermined value in the time duration $t_3$.

8. A system according to claim 6, in which the terminator means further comprises a voltage level detector operative to open the switch means of the terminator means when an input voltage thereto is above a predetermined level, and the first timing means comprises:

a capacitor;

first and second resistors; and a holding relay having contacts arranged to connect the first resistor and the capacitor in series across the power source, the source being adapted to supply direct current, when the holding relay coil is de-energized, and to connect the capacitor and second resistor in series across the power source when the relay coil is energized, the relay coil being de-energized when the initiator means energizes the feed means and energized by the sensing means when the presence of the first sheet is detected by the sensing means;

the input voltage to the level detector being the voltage across the capacitor which is set to a level lower than the predetermined level when the first timing means is set and rises to the predetermined level in the time duration $t_1$ when the capacitor is connected with the first resistor and rises to the predetermined level in the time duration $t_2$ when the capacitor is connected with the second resistor due to the selected values of the capacitor and the first and second resistors.

9. In an apparatus in which sheets are fed therethrough one by one at regular intervals, the combination therewith of:

sensing means arranged to detect the presence and absence of a sheet at a predetermined location in the sheet path; and timing means responsive to the sensing means;

the timing means comprising a first timer operative to measure the time interval between the initiation of feeding of the sheets and the detection of the presence of the first sheet by the sensing means and the time interval between the detection of the subsequent absence of one sheet and the detection of the presence of the next sheet by the sensing means and terminate feeding of the sheets when either of the measured time intervals exceeds the respective predetermined value, and a second timer operative to measure the time interval between the detection of the presence of a sheet and the detection of the subsequent absence of the same sheet and terminate feeding of the sheets when the measured time interval exceeds the respective predetermined value;

the first timer comprising changeover means responsive to the sensing means and arranged to control the selection of the time measuring interval of the first timer, the changeover means being arranged to assume a first state when feeding of the sheets is initiated in which the first timer is controlled to measure the time interval between the initiation of feeding of the sheets and the detection of the first sheet, and the changeover means is arranged to be shifted to a second state by the sensing means when the first sheet is detected by the sensing means in which the first timer is controlled to measure the time interval between the detection of the subsequent absence of one sheet and the detection of the presence of the next sheet.

10. The combination of claim 9, in which the sensing means comprises a switch.

11. In an electrophotographic machine having respective stations to perform the consecutive steps of charging, imaging, developing and transferring and feed means to feed transfer sheets through the transfer station one by one at regular intervals, the combination therewith of a system to detect a failure in the feeding of the sheet, the system comprising:

sensing means arranged at a point downstream of the transfer station in the sheet path operative to detect the presence and absence of a sheet at the point; and timing means responsive to the sensing means;

the timing means comprising a first timer operative to measure the time interval between the initiation of feeding of the sheet and the detection of the first sheet by the sensing means and the time interval between the detection of the subsequent absence of one sheet and the detection of the presence of the next sheet by the sensing means and de-energize the feed means when either of the measured time intervals exceeds the respective predetermined value, a second timer operative to measure the time interval between the detection of the presence of a sheet and the detection of the subsequent absence of the same sheet by the sensing means and de-energize the feed means when the measured time interval exceeds the respective predetermined value, and changeover means responsive to the sensing means and arranged to control the selection of the time measuring interval of the first timer;

the changeover means being arranged to assume a first state when feeding of the sheets is initiated in which the first timer is controlled to measure the time interval between the initiation of feeding of the sheets and the detection of the first sheet, and the changeover means being arranged to be shifted to a second state by the sensing means when the first sheet is detected by the sensing means in which the first timer is controlled to measure the time interval between the detection of the subsequent absence of one sheet and the detection of the presence of the next sheet.

* * * * *